US005609106A

United States Patent [19]

Aubermann

[11] Patent Number: 5,609,106

[45] Date of Patent: Mar. 11, 1997

[54] TRACK LAYING MACHINE FOR RENEWING RAILS

[75] Inventor: Tibor Aubermann, St Legier, Switzerland

[73] Assignee: Salpomec OY, Hollola, Finland

[21] Appl. No.: 416,916

[22] PCT Filed: Sep. 9, 1994

[86] PCT No.: PCT/EP94/03026

§ 371 Date: Apr. 21, 1995

§ 102(e) Date: Apr. 21, 1995

[87] PCT Pub. No.: WO95/08029

PCT Pub. Date: Mar. 23, 1995

[30] Foreign Application Priority Data

Sep. 16, 1993 [CH] Switzerland ..... 2778/93

[51] Int. Cl.[6] ..... E01B 29/02

[52] U.S. Cl. ..... 104/5

[58] Field of Search ..... 104/2, 5, 9, 7.1, 104/7.2, 7.3

[56] References Cited

U.S. PATENT DOCUMENTS

| | | | |
|---|---|---|---|
| 4,274,334 | 6/1981 | Lund | 104/5 |
| 4,325,306 | 4/1982 | Valditerra | 104/2 |
| 4,979,247 | 12/1990 | Buhler | 104/5 |
| 5,337,675 | 8/1996 | Aubermann | 104/5 |

FOREIGN PATENT DOCUMENTS

| | | |
|---|---|---|
| WO95/08029 | 3/1995 | European Pat. Off. . |
| 2016562 | 9/1979 | United Kingdom . |
| 2263493 | 7/1993 | United Kingdom . |

*Primary Examiner*—Robert J. Oberleitner
*Assistant Examiner*—C. T. Bartz
*Attorney, Agent, or Firm*—Kane, Dalsimer, Sullivan, Kurucz, Levy, Eisele and Richard, LLP

[57] ABSTRACT

A track building machine (34) for the renewal of tracks, essentially comprising a machine frame (1), supported on rail mountings (2, 3), having a work aggregate (38) exhibiting devices (5, 6, 7) for preparing a ballast bed, for lifting out old ties (8) and for laying new ties (9), and additionally comprising devices (35, 36, 10, 11, 12) for transporting the old and new ties (8, 9) and for raising, guiding and stretching apart old rails (13). For the support of the rail mounting (3) in working deployment, which rail mounting is disposed directly in front of the work aggregate (38) in the direction of working, a slide mechanism (18) is provided, which is rollable on the old ties (8). The work aggregate (38) for lifting out the old and laying the new ties (8, 9), outside a section limited by the rail mountings (2, 3) connected to the machine frame (1), is fastened on an extension arm (4) prolonging the machine frame (1). Between the extension arm (4) and the work aggregate (38) there is provided a vertical-adjustment device (20).

10 Claims, 10 Drawing Sheets

TRACK LAYING MACHINE FOR RENEWING RAILS

FIELD OF THE INVENTION

The invention relates to a track building machine for the renewal of tracks, comprising a machine frame, supported on rail mountings, having a work aggregate exhibiting devices for preparing a ballast bed, for lifting out old ties and for laying new ties, having devices for transporting the old and new ties and for raising, guiding and stretching apart old rails and having a slide mechanism, which is rollable on the old ties, for supporting a rail mounting in working deployment, which rail mounting is disposed directly in front of the work aggregate in the direction of working.

PRIOR ART

A track building machine of this type is already known by virtue of EP 0 168 103 A2. This machine comprises a first machine frame which is supported on two rail mountings and to which a second machine frame is attached. The latter is supported against the track, at its rear end in the direction of working, by a rail mounting. Directly nearby there is provided a vertically adjustable chain mounting, which is supported upon the newly laid ties as the said rail mounting is raised in working deployment. The rear rail mounting of the first machine frame, which is located in the region of the articulation, is deposited in working deployment onto a slide mechanism, which, for its part, is movable on the old ties.

From DE 29 09 575 B, a mobile device for laying rails and/or ties of a track is known, which exhibits two machine frames interconnected at one end by an articulated arrangement and resting respectively, at the other end, on a respective mounting, and in which the work aggregate for receiving the old ties and for laying the new ties and the devices for stretching apart the old rails and for laying the new rails are disposed between the two said mountings. In addition, in the region of the articulated arrangement of the two machine frames, a central mounting is provided, which is provided during the work phase with a slide mechanism which is displaceable directly on the ties of the track such that it is laterally guided by these.

A further type of the known track building machines for the renewal of tracks is described in DE 28 18 514 B. Here a mobile device for the continuous exchange or renewal of a track comprising rails and ties is represented, which device consists of a vehicle convoy, the main reconstruction part of which is configured as a supporting frame, which is mounted with both ends on rail mountings and on which, between the mountings, there are fitted the work elements for the exchange or renewal of the rails and/or ties. The supporting frame of this machine is formed from 2 frame parts interconnected in an articulated manner exhibiting, in the region beneath the frame articulation, a vertically adjustable third rail mounting. In a variant of this invention, there is provided in the region of the frame articulation an additional, vertically adjustable portal running gear for the temporary support of the supporting frame during the work journey, the portal running gear being movable on the new rails mounted in front in the front-head region of the ties.

The aforementioned known machines of the generic type exhibit a total of two machines or frame parts interconnected in an articulated manner, to which the work elements are fitted. The effect of this arrangement is that the machines require a large structural length, a heavy weight and correspondingly high costs.

SUMMARY OF THE INVENTION

The object of the present invention is to provide a track building machine for the renewal of tracks, which avoids the above-stated drawbacks of the known machine types and which, combined with a structural simplification and a low-cost construction, guarantees a qualitatively improved and operationally easier functioning.

This object is achieved according to the invention, using a track building machine of the generic type, by virtue of the fact that the work aggregate for lifting out the old and laying the new ties, outside a section limited by the rail mountings connected to the machine frame, is fastened on an extension arm prolonging the machine frame, and that between the extension arm and the work aggregate there is provided a vertical-adjustment device. The measures according to the invention enable the development of a track building machine for the renewal of tracks, which is distinguished by a simple and compact design which is shortened, in particular, in terms of the structural length. The suspension of the work aggregate from an extension arm jutting out above the rear rail mounting allows swift and simple functioning, which can be controlled by the operating staff in a clear-sighted manner. Work quality is guaranteed by the new ties being precisely deposited onto the ballast bed prepared by suitable devices, without the laid new ties having once again to be touched prior to the laying of the new rails. The risk of unwanted displacements of the new ties, resulting in a subsequent qualitatively deficient track bed, is thereby largely eliminated. The short design of the machine allows simple maneuvering and travel access to tight curves in the track and to locations having cramped spatial conditions.

An advantageous refinement of the invention consists in the fact that a supporting frame of the work aggregate, which supporting frame is connected to the vertical-adjustment devices, is connected at its rear end in the direction of working to a vertically adjustable auxiliary rail mounting. This design variant creates, for transport journeys, improved travel conditions, since the not insignificant mass of the work aggregate is supported on the track by an additional rail mounting and the rear rail mounting of the machine frame or main frame is thereby relieved of load. At the same time, without any adverse effect upon the work quality and without any significant extension of the structural length, an improved maneuverability of the track building machine and the possibility of fitting traction and buffing gears in its rear region is thereby achieved.

In the embodiment according to claim 5, a yet more far-reaching advantage is created by the fact that a transport vehicle is provided, which is supported on rail mountings and exhibits a loading platform for supporting the work aggregate during machine transport and which can be releasably connected by a coupling device to the rear end of the machine frame in the direction of working. This advantageous embodiment has the effect, for transport and maneuvering journeys, of providing exemption from burdensome provisions under railroad transport regulations, since the traction forces and shock forces which are generated during conveyance in the train convoy are able to be conducted by the additional transport vehicle directly into the machine frame or main frame, without these traction and shock forces having to pass through the work aggregate and the backwardly protruding extension arm. Complex constructions in this region of the machine, for absorbing the considerable shock and traction forces in transport operations, are thereby superfluous. The machine is thus easily transportable from one construction site to the other.

A further advantageous embodiment according to claim 6 envisages that the work aggregate is equipped, in its rear end region in the direction of working, with devices for laying rails onto the ties. This embodiment allows the machine to be equipped, by simple and inexpensive means, for the complete renewal of the track and enables not only ties but also rails to be exchanged. This embodiment allows new rails to be placed onto the new ties, so that the machine leaves behind it a fully renewed track on which only the rail screw-connections still have to be fitted. The facility herein exists both for reintroducing the old rails, which were stretched out for the exchange of the ties, and laying them on the new ties (changing only the ties, whilst the old rails are reused) and, indeed, for laying new rails onto the new ties, the new rails having previously been deposited on the track, preferably in front of the tie heads.

A further variant envisages a track building machine according to claim 7, in which the additional transport vehicle, which primarily serves to deposit the work aggregate in the transport setting, is equipped with devices for laying rails onto the ties. In order to be able to lower the work aggregate during the work phase into the work setting, the additional rail vehicle is carried along behind the machine, by means of a distance coupler, at the spacing necessary for optimal functioning, the laying of the rails being effected from the additional transport vehicle. The distance coupler is expediently configured such that the energy which is necessary for the laying of the rails can also be passed via it from the track building machine to the transport vehicle. In order to be able to drive the transport vehicle, during the transport setting, beneath the work aggregate which has been raised for this purpose, the devices for laying the new rails, the work post earmarked for this purpose and any further work elements should expediently be designed to be foldable and/or displaceable. This embodiment allows the transport vehicle to be carried along in a simple manner during the work, without any need for it to have a dedicated drive system and energy supply. At the same time, the laying of the new rails is able to be carried out from the transport vehicle, a variable distance coupler length enabling the work to be conducted in an optimal and material-saving manner.

An advantageous combination of the track building machine according to the invention is one which, according to claim 8, has a transport vehicle which is designed for working deployment behind the track building machine and has a vehicle frame supported on rail mountings, a drive unit, a driving or operating cab having a central control unit, and devices—vertically and laterally adjustable—which are provided in the region of the driving or operating cab and jut out over the end of the vehicle frame, for guiding and depositing rails on ties.

The advantage of this system is that the transport vehicle, during the work phase, is able to operate fully independently of the track building machine. This can be advantageous for the laying of the new rails, since this can be done independently of the speed of advance of the track building machine. This independence simultaneously enables other operations as well, such as material or passenger transport or other functions, to be carried out on the track by use of the additional transport or rail-laying vehicle provided with its own drive and energy supply. This therefore offers greater flexibility for the execution of the entire track renewal construction project and can thus yield overall savings in terms of costs and labor expenditure.

BRIEF DESCRIPTION OF THE DRAWINGS

The invention is explained below with reference to illustrative embodiments which are represented diagrammatically.

DESCRIPTION OF THE PREFERRED EMBODIMENTS

Figure 1:
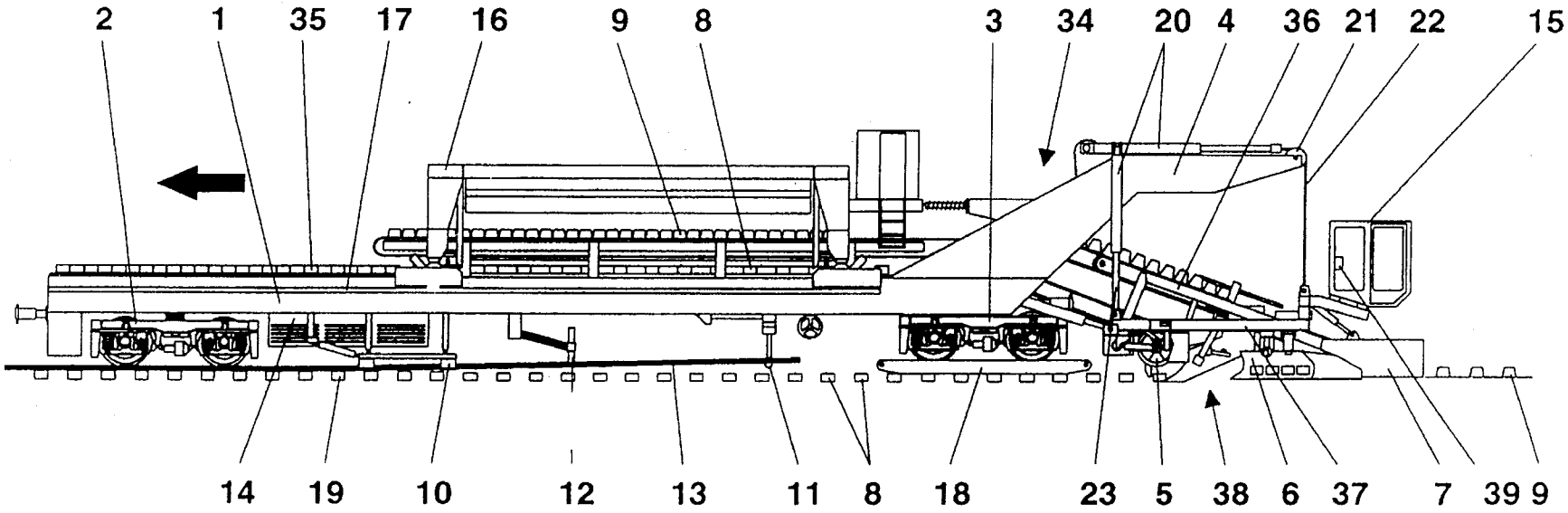
FIG. 1 shows a schematic side view of a first design variant of the track building machine according to the invention.
Figure 1A:
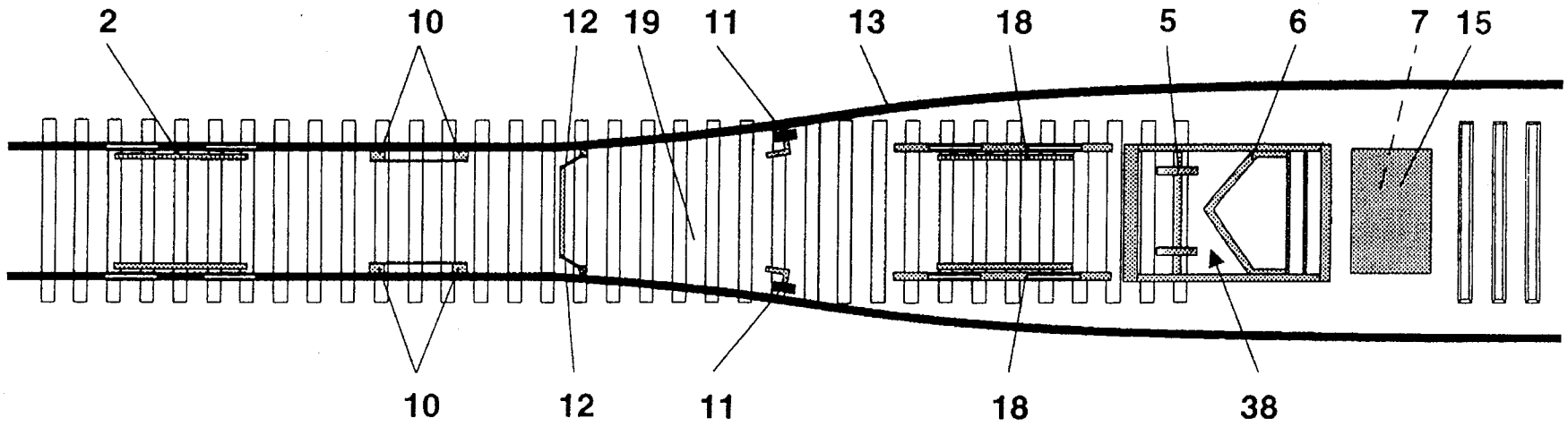
FIG. 1*a* shows a schematic top view of the machine according to FIG. 1, exhibiting the front chassis, the means for stretching apart and guiding the old rails, slide mechanisms which move on the ties after they have been freed from the rails, and the work aggregate having devices for receiving the old ties, a device for preparing the ballast bed and the device for laying new ties.

The drawings are shown in purely schematic representation so as to facilitate understanding of the invention. They represent only certain design variants according to the invention; further variants covered by the invention are conceivable, but are not represented.

The track building machine 34 exhibits a machine frame 1, which is supported on a front rail mounting 2 and a rear rail mounting 3. Jutting out over the rear rail mounting 3, in the direction of working, of the machine 34 is an extension arm 4, from which there are suspended, as work elements for the track renewal, devices 5 for raising old ties 8, devices 6 for preparing the ballast bed and devices 7 for laying new ties 9. 0n the machine frame or main frame 1 there are further provided devices 35, 36, configured as conveyor belts, for carrying away the old ties 8 and delivering the new ties 9. The machine frame 1 additionally supports devices 10, 11, 12 for raising, guiding and stretching apart the old rails 13. The track building machine 34 is provided with a motor installation 14, which supplies the energy for work and for forward travel. The control of the basic work functions is carried out from the operating cab 15 positioned behind the extension arm 4 in the direction of working, by use of a central control unit 39. In addition, a portal crane 16 is provided for transportation of the old ties 8 and new ties 9, which portal crane can be moved on the machine frame 1, and on any tie transport trucks which may have been coupled in front of it, by means of a running rail 17.

During the work phase, the rear rail mounting 3 is supported on slide mechanisms 18, which are movable on the old ties 8 of the old track 19, which have been freed from the old rails 13. The old ties 8 herein simultaneously provide lateral guidance, since the slide mechanisms 18 expediently progress in the ribbed plates or in the region of the rail bed.

The raising or lowering of a work aggregate 38 supporting the work elements or devices 5, 6, 7 on a supporting frame 37 is realized by suitable hydraulic cylinders, described generally as a vertical-adjustment device 20, which are attached to the extension arm 4 and are connected by means of a roller 21 and a carrying cable 22, as well as a lifting rod 23, to the work aggregate 38.

Figure 2:
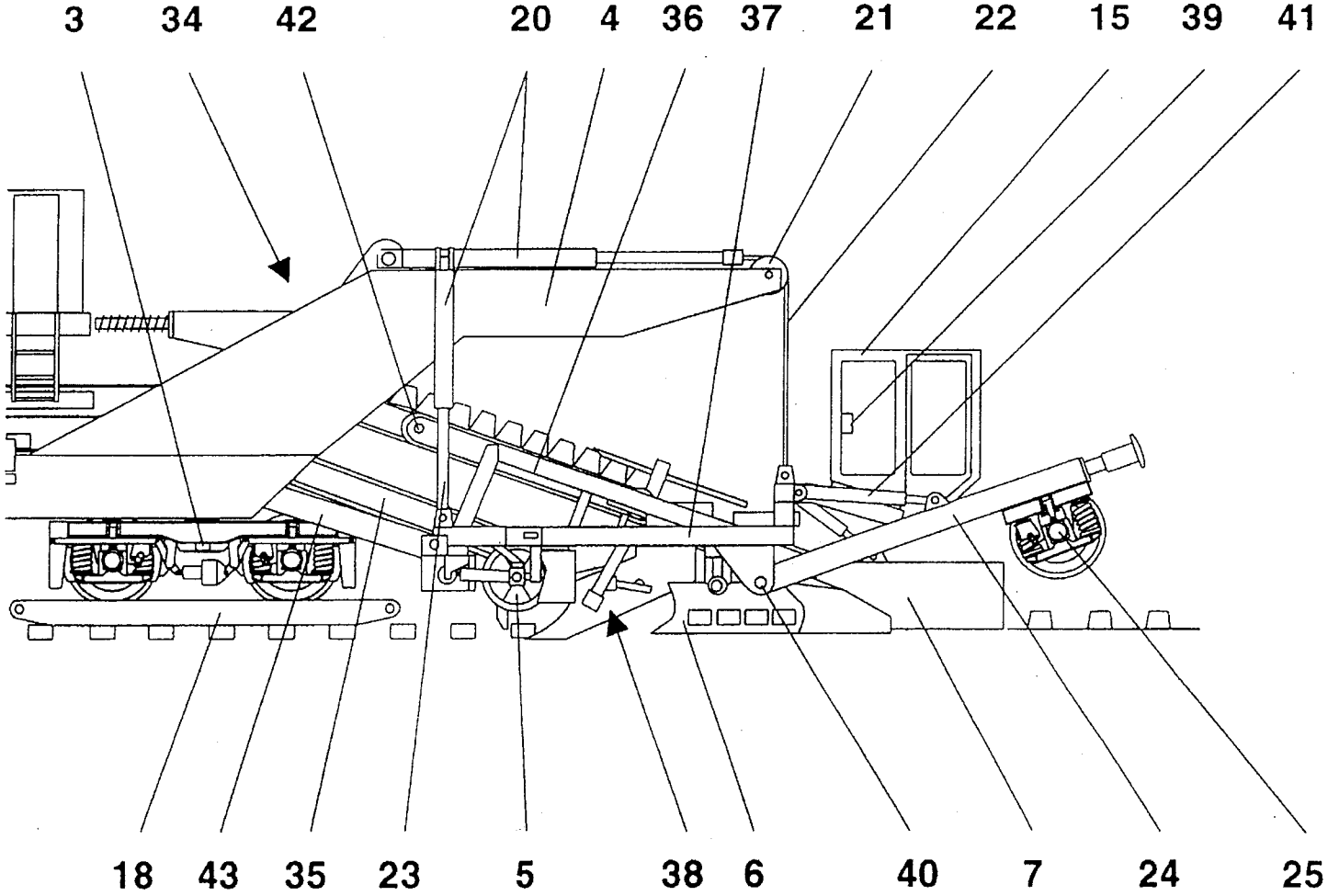
FIG. 2 shows the enlarged, rear part of the track building machine according to FIG. 1, exhibiting an auxiliary rail mounting, in work setting.
Figure 2A:
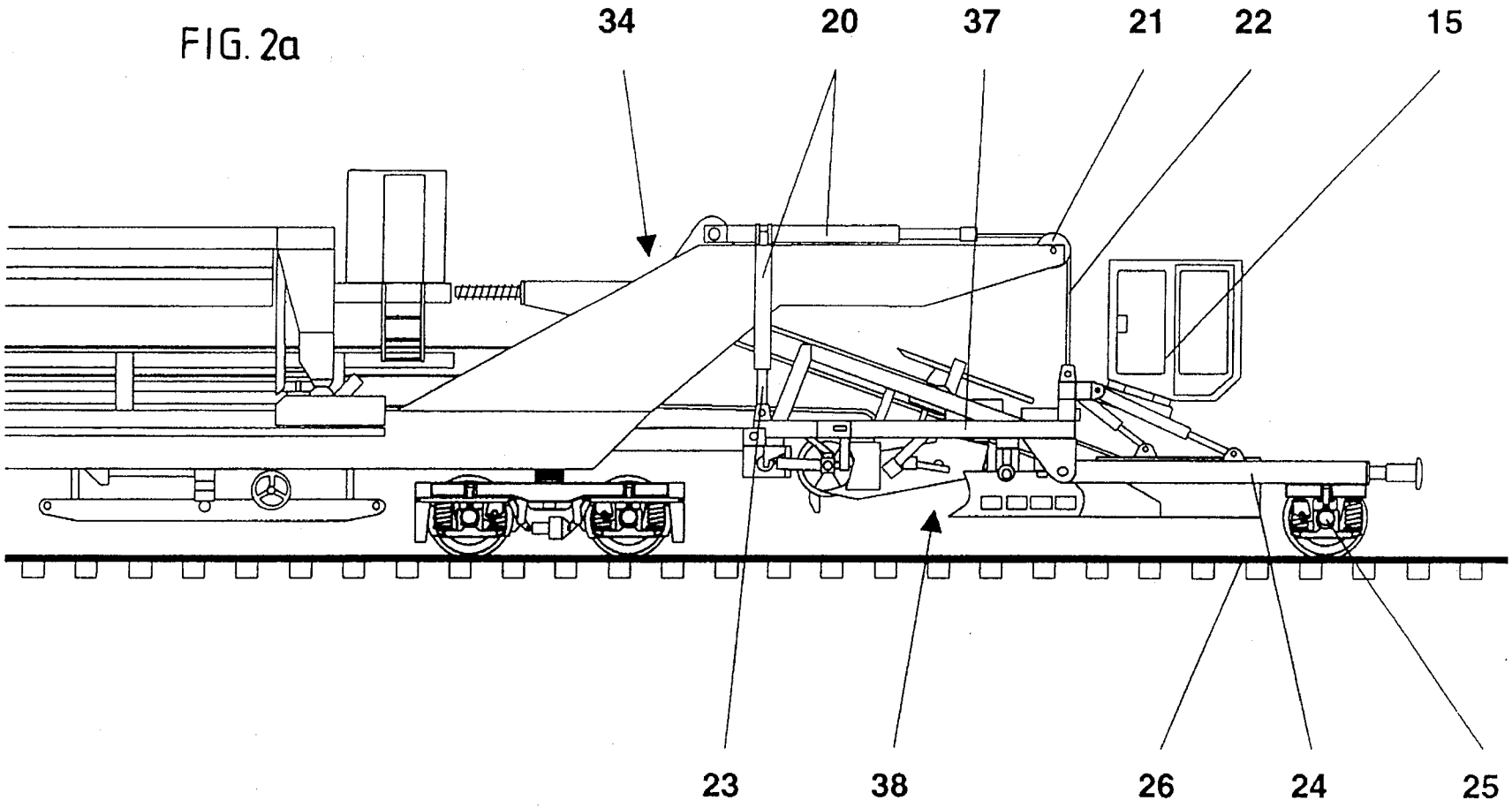
FIG. 2*a* represents the same embodiment in transport setting.

A mounting frame 24, which, according to FIG. 2, is attached as a variant of the invention to the work aggregate, supports an auxiliary rail mounting 25, which rests only in the transport setting on the track 26. By means of the vertical-adjustment device 20, the carrying cable 22 and the lifting rod 23 are drawn in, whereby the work aggregate 38 is raised, together with the supporting frame 37, into a transport setting (FIG. 2*a*). The auxiliary rail mounting 25 is fastened on the end side on the mounting frame 24, which, for its part, is connected by its front end in the direction of working, said front end lying opposite the auxiliary rail mounting 25, via an articulation 40 having a swivel axis running horizontally and perpendicular to the longitudinal direction of the machine, to the supporting frame 37. For the pivoting or vertical adjustment of the mounting frame 24, together with the auxiliary rail mounting 25, a swivel drive 41 is provided. In order to enable the work aggregate 38 to be vertically adjusted, each device 35, 36 for the transportation of the old and new ties, respectively, exhibits in its rear end region an articulation 42. The supporting frame 37 is connected by a link rod 43 in an articulated manner to the rear end of the machine frame 1.

Figure 3:
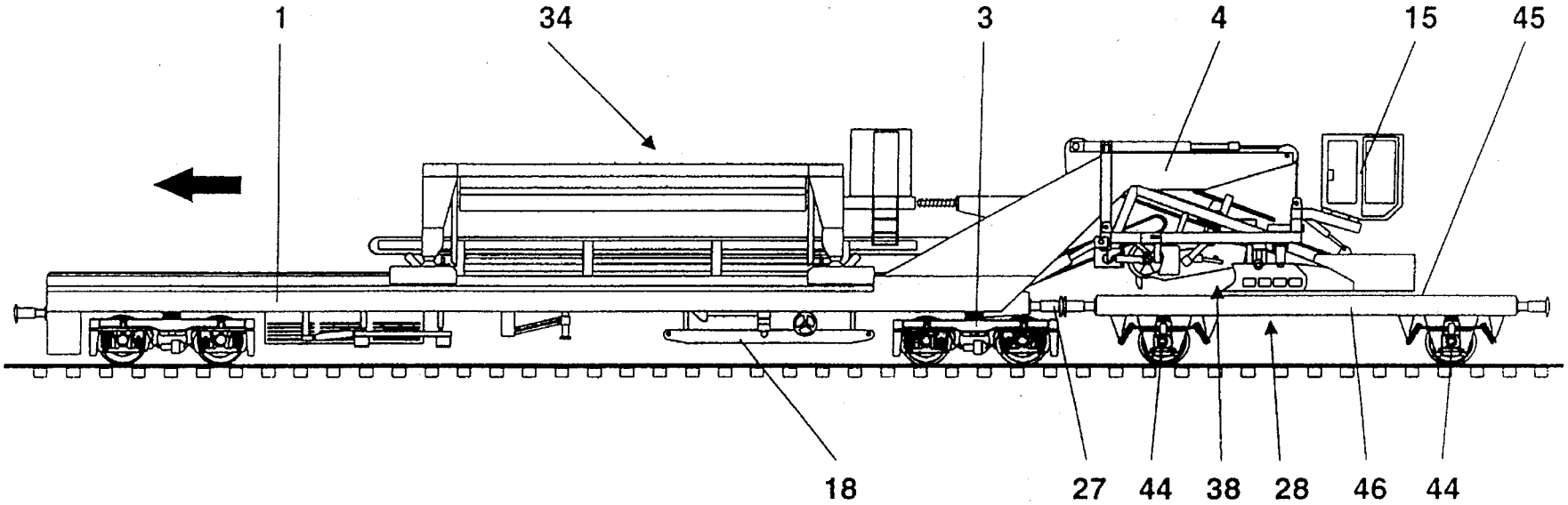
FIG. 3 represents a further design variant of the track building machine, exhibiting a transport vehicle which is designed to support the work aggregate during the passing-over journeys.

As represented in FIG. 3, the track building machine 34 supports at the rear end, in the direction of working (arrow), of its machine frame 1, traction and buffing gears 27, by means of which an additional transport vehicle 28 can be coupled up. This is supported on rail mountings 44 and exhibits a loading platform 45 for supporting the work aggregate 38 during machine transport. As a result of this support, the rear mounting 3 of the machine 34 is relieved of load. At the same time, the track building machine 34 can be configured for the transport journey as a control vehicle as defined under the pertinent railroad regulations, since the traction and shock forces which are generated in the transport operations are conducted by the vehicle frame 46 of the additional transport vehicle 28 directly into the machine frame 1 of the track building machine 34.

Figure 4:
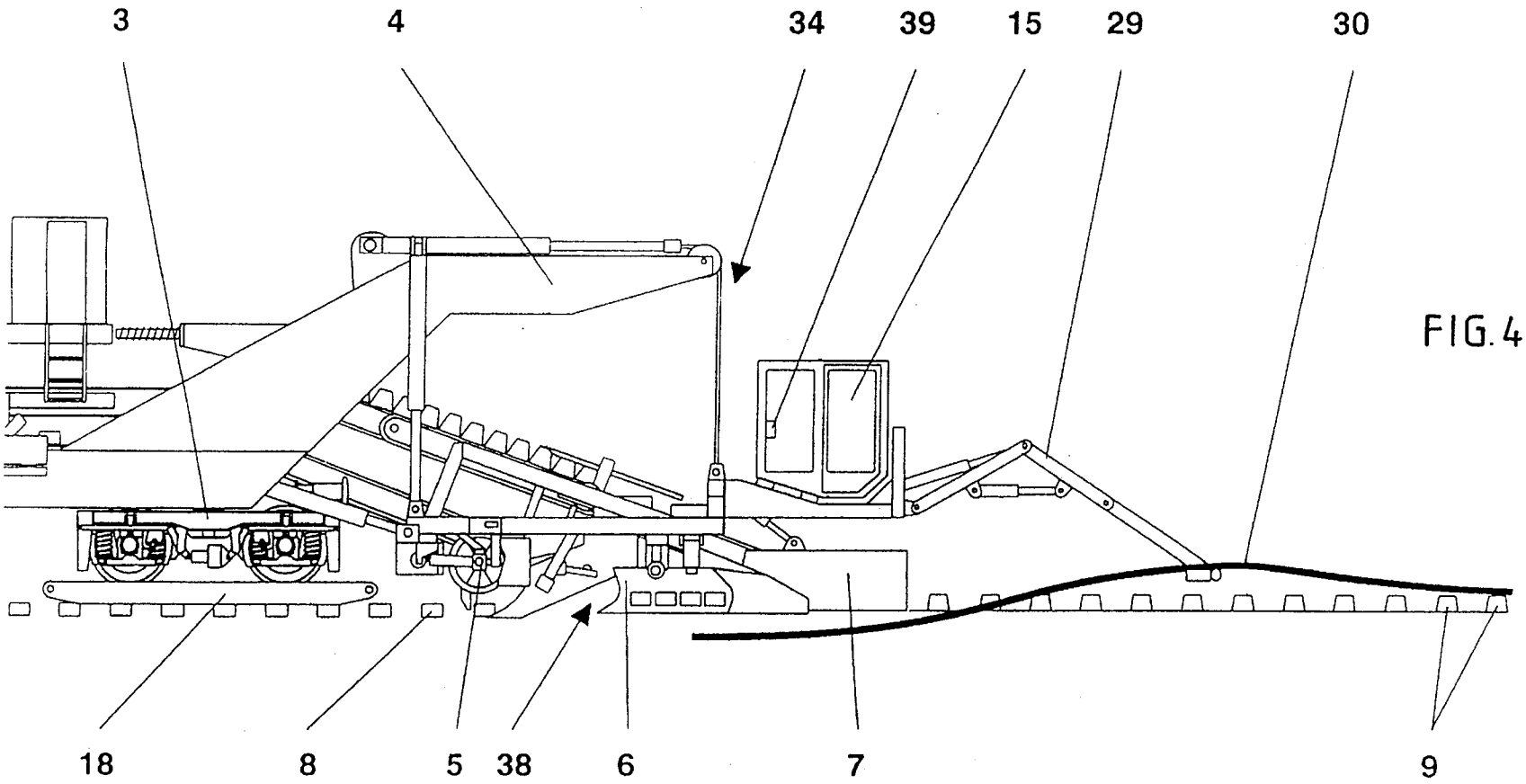
FIG. 4 illustrates a design variant of the track building machine exhibiting a device for laying the rails onto the new ties.
Figure 4A:
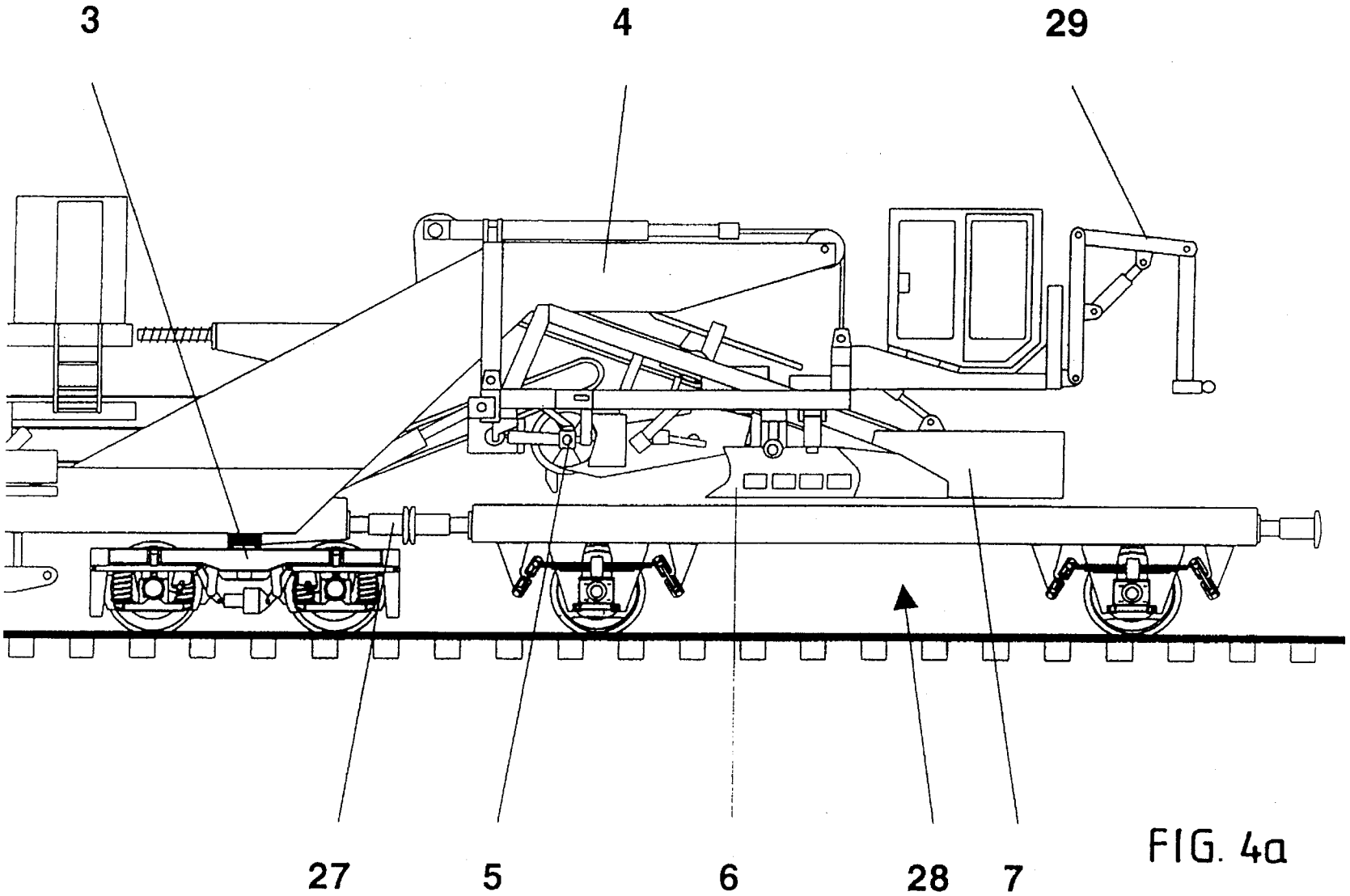
FIG. 4*a* shows the same design variant in transport setting, the work aggregate provided at the rear machine end being supported on an additional transport vehicle coupled to the main frame.

As shown in FIG. 4, vertically and laterally adjustable devices 29 for laying new rails 30 onto the laid new ties 9 are additionally attached to the rear part of the track building machine 34. Expediently, the new rails 30 are pre-mounted for this purpose into the region in front of the tie heads or in the middle of the track. For the execution of a tie renewal only, the devices 29 can also be used, where appropriate, to re-lay the old rails 13 which were stretched apart as the ties were exchanged.

Figure 5:
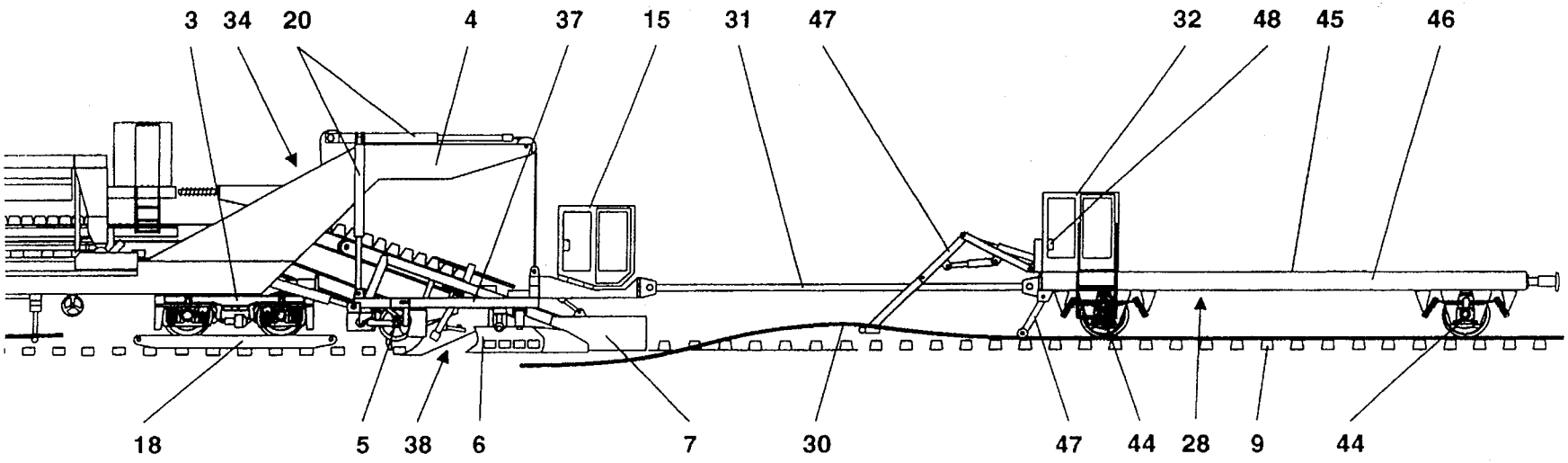
FIG. 5 shows the transport vehicle which is coupled to the track building machine by means of a distance coupler and which exhibits devices for laying the new rails and a device for keeping the new rails on track.
Figure 5A:
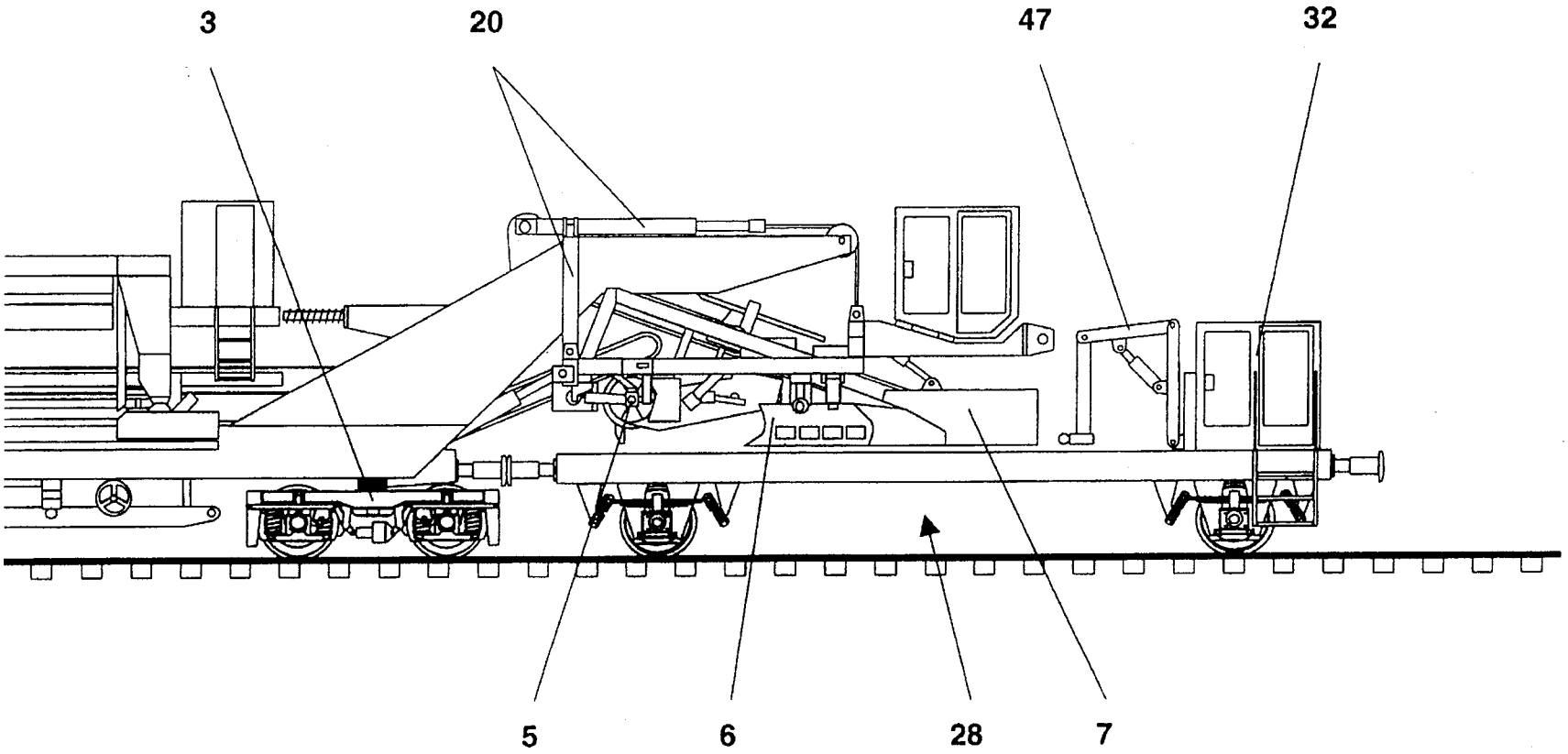
FIG. 5*a* shows the same design variant in transport setting.

Devices 47 for laying the rails onto the laid new ties 9 can also be disposed on the additional transport vehicle 28. As represented in FIG. 5, the devices 47 are attached to the front region of the transport vehicle 28. A distance coupler or distance rod 31 serves to carry along the transport vehicle 28 with the track building machine 34 during working. An operating cab 32 having a control unit 48 is provided on the transport vehicle 28 displaceably in the longitudinal direction of the latter, thereby enabling it to be moved, in the transport setting, to the rear end of the transport vehicle 28. A loading platform 45 of the vehicle frame 46 can be used to support the work aggregate 38 during the machine transport.

Figure 6:
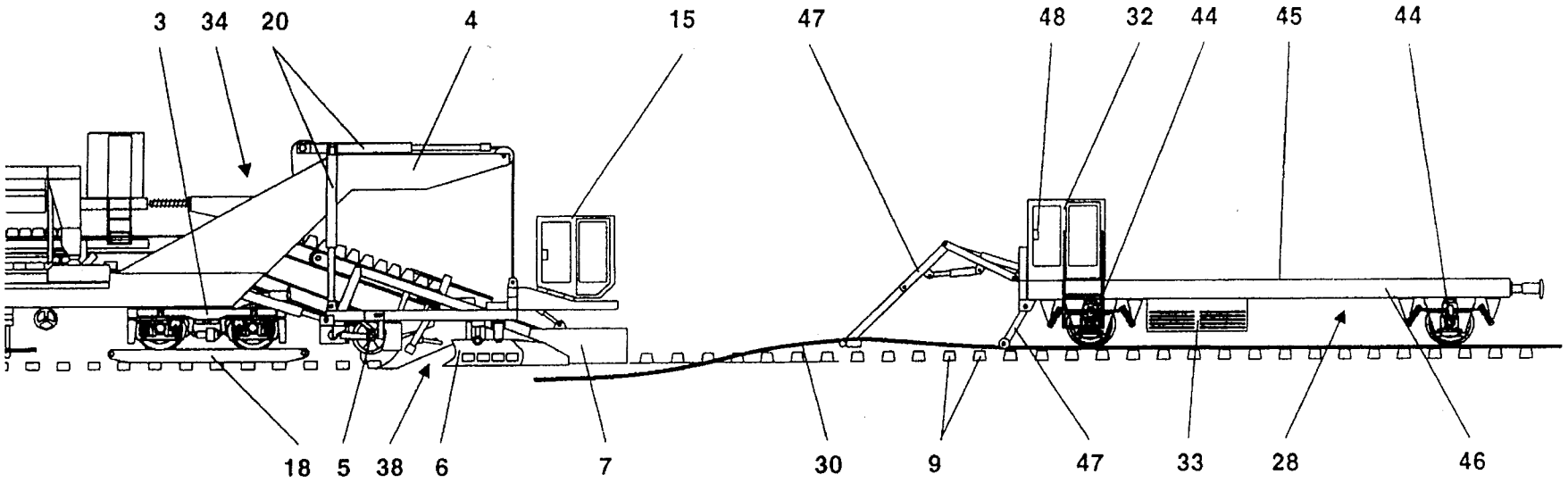
FIG. 6 shows a combination of an independent transport or rail-laying vehicle having its own drive and energy supply and the track building machine which is placed in front of it in the direction of workinging.

In the design variant shown in FIG. 6, the additional transport vehicle 28 is provided with its own drive unit 33, which allows forward travel and work to be carried out independently of the track building machine 34 and independently of the speed of advance of the latter.

| Reference symbol listing | |
|---|---|
| 1 | machine frame |
| 2 | front rail mounting |
| 3 | rear rail mounting |
| 4 | extension arm |
| 5 | device for lifting out old ties |
| 6 | device for preparing ballast bed |
| 7 | device for laying new ties |
| 8 | old ties |
| 9 | new ties |
| 10 | device for raising old rails |
| 11 | device for guiding old rails |
| 12 | device for stretching apart old rails |
| 13 | old rails |
| 14 | motor installation |
| 15 | operating cab |
| 16 | portal crane |
| 17 | running rail |
| 18 | slide mechanism |
| 19 | old track |
| 20 | vertical-adjustment device |
| 21 | roller |
| 22 | carrying cable |
| 23 | lifting rod |
| 24 | mounting frame |
| 25 | auxiliary rail mounting |
| 26 | track |
| 27 | coupling device |
| 28 | transport vehicle |
| 29 | device for laying rails |
| 30 | new rails |
| 31 | distance rod |
| 32 | operating cab |
| 33 | drive unit |
| 34 | track building machine |
| 35 | device (transportation of old ties) |
| 36 | device (transportation of new ties) |
| 37 | supporting frame |
| 38 | work aggregate |
| 39 | central control unit |
| 40 | articulation |
| 41 | swivel drive |
| 42 | articulation |

-continued

| Reference symbol listing | |
|---|---|
| 43 | articulated rod |
| 44 | rail mounting |
| 45 | loading platform |
| 46 | vehicle frame |
| 47 | device for laying rails |
| 48 | control unit |

What is claim is:

1. A track building machine for the renewal of tracks, comprising a single machine frame (1) with a front and a rear end supported on two rail mountings (2, 3) having a work aggregate (38) exhibiting devices (5, 6, 7) for preparing a ballast bed, for lifting out old ties (8) and for laying new ties (9), having devices (35, 36, 10, 11, 12) for transporting the old and new ties (8, 9) and for raising, guiding and stretching apart old rails (13) and having a slide mechanism (18), which is rollable on the old ties (8), for supporting the rail mounting (3) in working deployment, which rail mounting is disposed directly in front of the work aggregate (38) in the direction of working, wherein the work aggregate (38) for lifting out the old and laying the new ties (8, 9) is located outside a section of the machine frame (1) between the rail mountings (2, 3) connected to the machine frame (1) and is fastened on an extension arm (4) which juts out over the rear end of the machine frame (1), and wherein between the extension arm (4) and the work aggregate (38) there is provided a vertical-adjustment device (20).

2. The machine as claimed in claim 1, wherein a supporting frame (37) of the work aggregate (38), which supporting frame is connected to the vertical-adjustment devices (20), is connected at its rear end in the direction of working to a vertically adjustable auxiliary rail mounting (25).

3. The machine as claimed in claim 2, wherein the auxiliary rail mounting (25) is fastened on the end side on a mounting frame (24), which, for its part, is connected by its front end in the direction of working, said front end lying opposite the auxiliary rail mounting (25), via an articulation (40) having a swivel axis running horizontally and perpendicular to the longitudinal direction of the machine, to the supporting frame (37), and wherein, for the pivoting of the mounting frame (24), a swivel drive (41) is provided.

4. The machine as claimed in claim 1, wherein the work aggregate (38) exhibits, at its rear end in the direction of working, an operating cab (15) having a central control unit (39).

5. The machine as claimed in claim 1, which has a transport vehicle (28), which is supported on rail mountings (44) and exhibits a loading platform (45) for supporting the work aggregate (38) during machine transport and which can be releasably connected by a coupling device (27) to the rear end of the machine frame (1) in the direction of working.

6. The machine as claimed in claim 1, wherein the work aggregate (38) is equipped, in its rear end region in the direction of working, with devices (29) for laying rails (30, 13) onto the ties (9).

7. The machine as claimed in claim 5, wherein the transport vehicle (28) is equipped with devices (47) for laying rails (30) onto the ties (9), and wherein—in working deployment—a distance coupler (31) is provided between the machine frame (1) and the transport vehicle (28).

8. A system for the renewal of tracks, having a track building machine as claimed in claim 1, the system having a transport vehicle (28) which is designed for working deployment behind the track building machine (34) and has a vehicle frame (46) supported on rail mountings (44), a drive unit (33), a driving or operating cab (32) having a central control unit (48), and devices (47)—vertically and laterally adjustable—which are provided in the region of the driving or operating cab (32) and jut out over the end of the vehicle frame (46), for guiding and depositing rails (30, 13) on ties (9).

9. The system as claimed in claim 8, wherein the vehicle frame (46) exhibits a loading platform (45) for supporting, during machine transport, the work aggregate (38) connected to the machine frame (1).

10. The system as claimed in one of claim 8, wherein the driving or operating cab (32) and the devices (47) for guiding and depositing rails (30) are mounted displaceably on the vehicle frame (46) in the longitudinal direction of the machine.

* * * * *

UNITED STATES PATENT AND TRADEMARK OFFICE

CERTIFICATE OF CORRECTION

PATENT NO. : 5,609,106

DATED : March 11, 1997

INVENTOR(S) : Tibor Aubermann

It is certified that error appears in the above-indentified patent and that said Letters Patent is hereby corrected as shown below:

Title page, item [73] Assignee: please delete "Salpomec OY, Hollola, Finland" and insert --MATISA MATERIEL INDUSTRIEL S.A., Crissier, Switzerland--

Signed and Sealed this

Fifth Day of August, 1997

Bruce Lehman

*Attest:*

BRUCE LEHMAN

*Attesting Officer*

*Commissioner of Patents and Trademarks*